US005976673A

United States Patent [19]

Aoki

[11] Patent Number: 5,976,673

[45] Date of Patent: Nov. 2, 1999

[54] INK-JET PRINTING CLOTH, INK-JET PRINTING PROCESS AND PRINT

[75] Inventor: Makoto Aoki, Yokohama, Japan

[73] Assignee: Canon Kabushiki Kaisha, Tokyo, Japan

[21] Appl. No.: 08/797,709

[22] Filed: Feb. 11, 1997

[30] Foreign Application Priority Data

Feb. 15, 1996 [JP] Japan ..... 8-028245
Feb. 5, 1997 [JP] Japan ..... 9-022582

[51] Int. Cl.[6] ..... B41M 5/00; B41J 2/01

[52] U.S. Cl. ..... 428/195; 347/105; 347/106; 442/79; 442/82; 442/118; 442/152

[58] Field of Search ..... 428/195; 442/152, 442/79, 82, 118; 347/105, 106

[56] References Cited

U.S. PATENT DOCUMENTS 3,711,884 1/1973 Feig ..... 15/104.93
5,468,553 11/1995 Koike et al. ..... 428/224
5,494,733 2/1996 Koike et al. ..... 428/224
5,594,485 1/1997 Koike et al. ..... 347/101

FOREIGN PATENT DOCUMENTS

0605730A1 7/1994 European Pat. Off. .
63-31593 6/1988 Japan .
2-68372 3/1990 Japan .
2-112489 4/1990 Japan .
4-59282 2/1992 Japan .
5-212851 8/1993 Japan .
6-200485 7/1994 Japan .
9-279490 10/1997 Japan .
002069677 9/1998 Japan .

*Primary Examiner*—Pamela R. Schwartz
*Attorney, Agent, or Firm*—Fitzpatrick, Cella, Harper & Scinto

[57] ABSTRACT

Disclosed herein is an ink-jet printing cloth comprising a thickening surfactant in an amount of from 0.1 to 30% by weight and an aqueous auxiliary for thickening the thickening surfactant in an amount of from 0.1 to 30% by weight, based on the weight of the cloth, respectively.

21 Claims, 4 Drawing Sheets

1
11
13
15
150
110
1110,1120
1000
140
1100
100
1010
140
1022
1020
1012
1032
f
130
1030
1B
120
133
1
130
17
19
600
21

INK-JET PRINTING CLOTH, INK-JET PRINTING PROCESS AND PRINT

BACKGROUND OF THE INVENTION

1. Field of the Invention

The present invention relates to an ink-jet printing cloth, an ink-jet printing process and a print obtained by the ink-jet printing process.

2. Related Background Art

Besides screen printing and roller printing, ink-jet printing has heretofore been known as a process of printing on cloth. Since the ink-jet printing is a system of which any plate such as a screen or a design roller is not required, it is fit for the multi-kind small-quantity production. The techniques required of the ink-jet printing are greatly different from those of the screen and roller printing. This is caused by such differences in system that the optimum value of viscosity among properties of inks used in the ink-jet printing is greatly different from that of textile printing inks used in screen printing or the like and is considerably low, that the ink-jet printing requires to take steps as to reliability such as clogging of a head, so-called additive color process, in which a few inks of different colors are shot on the same position so as to overlap each other, is conducted, and that dots of inks are very small.

Various investigations have thus been attempted as to methods of such ink-jet printing, in particular, improvement in coloring, prevention of bleeding and the like. For example, with respect to cloth used in such a printing process, Japanese Patent Application Laid-Open No. 4-59282 discloses an ink-jet printing cloth formed of a hydrophilic fiber material and containing 0.1 to 3% by weight of a surfactant. According to the cloth subjected to such a treatment, inks are absorbed in the interior of fiber by diffusion, and so the migration length of the inks becomes comparatively short, and great bleeding is prevented to some extent. However, such a cloth is (unfavorable to improvement in coloring ability because dyes penetrate into the interior of the fiber. Even when a shot-in ink quality is increased to raise the color depth of the resulting print, the color depth on the surface thereof cannot be enhanced because the inks are absorbed in the interior of the cloth.

Even when no surfactant is used, inks are absorbed in the interior of such a cloth like the above unless a substance for decelerating time of water absorption is applied to the cloth, so that the color depth on the surface of the resulting print cannot be enhanced.

On the other hand, Japanese Patent Publication No. 63-31593 discloses a textile printing method in which inks each having a viscosity of 200 cP or lower and a surface tension of 30 to 70 dyn/cm, and a cloth having a water repellency of 50 marks or more as measured in accordance with JIS L 1079 are used. Since this printing method is based on thinking that the penetration of inks into the interior of fiber is prevented to prevent the diffusion of dyes, thereby improving coloring, the improvement in a coloring ability is recognized to some extent. However, the method involves problems such as (1) it takes a long time to dry the inks, and (2) an area factor (a proportion of dots per unit area) becomes small because the inks do not spread, and so the coloring ability is limited.

As described above, the prior art techniques have been able to satisfy individual performance characteristics required of the ink-jet printing process for obtaining excellent prints to some extent, but have been unable to satisfy the various performance characteristics at the same time.

SUMMARY OF THE INVENTION

It is therefore an object of the present invention to provide an ink-jet printing cloth and an ink-jet printing process, which can provide bright prints excellent in drying property, free of bleeding and high in color depth, image quality and grade, and an ink-jet print excellent in properties.

The above object can be achieved by the present invention described below.

According to the present invention, there is thus provided an ink-jet printing cloth comprising a thickening surfactant in an amount of from 0.1 to 30% by weight and an aqueous auxiliary for thickening the thickening surfactant in an amount of from 0.1 to 30% by weight, based on the weight of the cloth, respectively.

According to the present invention, there is also provided an ink-jet printing process comprising ejecting inks from an ink-jet printing apparatus to print a cloth, wherein the cloth described above is used as said cloth.

According to the present invention, there is further provided a print produced in accordance with the ink-jet printing process described above.

DESCRIPTION OF THE PREFERRED EMBODIMENTS

Figures 1A, 1B:
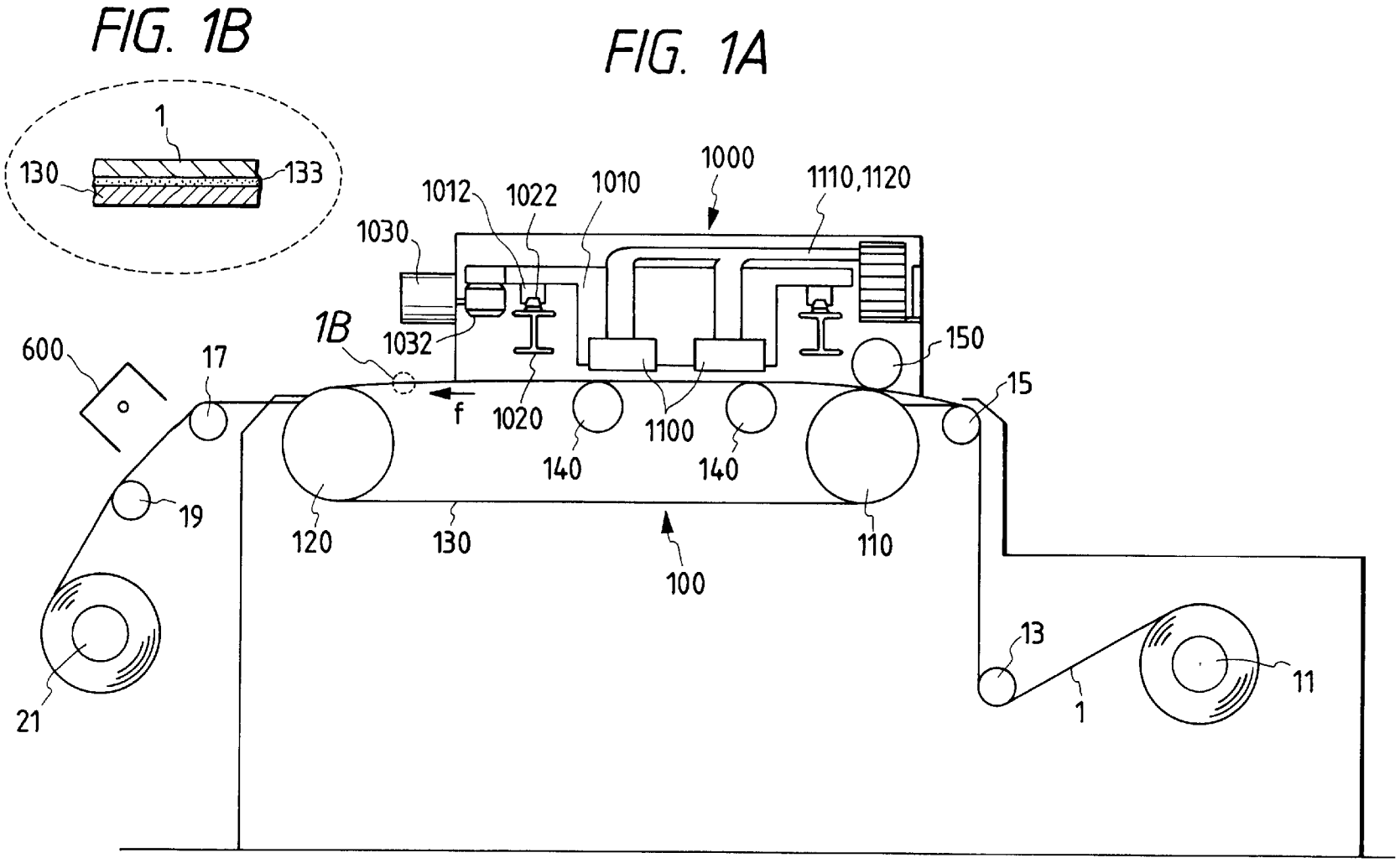
FIG. 1A is a typical sectional side elevation schematically illustrating the construction of an ink-jet printing apparatus to which the present invention is applied.
FIG. 1B is an enlarged view of a portion of a conveyor belt in FIG. 1A.

No particular limitation is imposed on a fiber material for the ink-jet printing cloth according to the present invention. Examples thereof include various fiber materials such as cotton, silk, wool, nylon, polyester, rayon and acrylic fibers. The cloth used may be a blended fabric or union cloth thereof.

The thickening surfactant and aqueous auxiliary used in the present invention exhibit a thickening effect by using them in combination, while they scarcely have the thickening effect when they are used singly.

As the aqueous auxiliary used in the present invention, hydrophilic surfactants among surfactants such as anionic, nonionic and amphoteric surfactants, and hydrophilic high-boiling organic solvents are preferred. Examples of the anionic surfactants include anionic surfactant of the sulfonic acid, carboxylic acid, sulfuric ester and phosphoric ester types. Examples of the anionic surfactants of the sulfonic acid type include sulfonate type anionic surfactants of the alkyl sulfonate and alkyl allyl sulfonate types. Examples of the anionic surfactants of the carboxylic acid type include soaps and fat-protein condensates. Examples of the anionic surfactants of the sulfuric ester type include sulfuric esters of higher alcohols, sulfuric esters of ethylene oxide adducts of higher alcohols, esters of sulfoolefins and esters of sulfofatty acids. Examples of the anionic surfactants of the phosphoric ester type include phosphoric esters of higher alcohols and phosphoric esters of ethylene oxide adducts of higher alcohols.

As the nonionic surfactants, there may be used nonionic surfactants of the ether type, such as polyoxyethylene alkyl ethers, polyoxyethylene alkyl allyl ethers, polyoxyethylene polyoxypropylene ethers and acetylene glycol, nonionic surfactants of the ester type, such as polyoxyethylene alkyl esters and sorbitan fatty acid esters, nonionic surfactants of the aminoether type, such as polyoxyethylene alkylamine, nonionic surfactants of the ether ester type, such as polyoxyethylene sorbitan fatty acid esters, and the like.

As the amphoteric surfactants, there may be used betaine type amphoteric surfactants and the like.

Among these above, it is particularly preferable to use a nonionic surfactant having an HLB of not less than 12.5, preferably not less than 14.

As the hydrophilic high-boiling organic solvents, there may be used glycerol, polyethylene glycol and the like.

The amount of the aqueous auxiliary to be applied to the cloth is preferably from 0.1 to 30% by weight, more preferably from 0.1 to 10% by weight based on the cloth. Even if the amount to be applied exceeds 30% by weight, no change is recognized in the thickening ability thereof. It is hence not preferable from the viewpoint of economy to use the aqueous auxiliary in any amount more than 30% by weight. If the amount is less than 0.1% by weight, its effect is somewhat lowered.

As the thickening surfactant used in combination with the aqueous auxiliary, strongly lipophilic surfactants among anionic and nonionic surfactants may be used. With respect to the intensity of the lipophilicity, those having an HLB of 12 or lower are preferred for the nonionic surfactants. In particular, those of the polyoxyethylene alkyl ether type having an HLB of 12 or lower exhibit a high thickening effect. The reason why the specific combination of the aqueous auxiliary with the thickening surfactant causes the thickening effect is not clearly known. It is however considered that the structure and size of micelle are changed by the surfactant, thereby changing the binding power between colloidal particles, and so the viscosity is changed.

The thickening surfactant is preferably contained in a proportion of from 0.1 to 30% by weight, more preferably from 0.1 to 10% by weight based on the cloth.

A weight ratio of the aqueous auxiliary to the thickening surfactant to be used in combination is within a range of from 1:5 to 5:1,preferably from 1:3 to 3:1. The thickening effectively occurs so far as the weight ratio falls within this range.

The thickening effect may be explained as follows. Namely, when, for example, a combination of an aqueous auxiliary with a thickening surfactant in which, when an aqueous solution of the aqueous auxiliary having a certain viscosity $X_{cP}$ dissolves the thickening surfactant having a viscosity lower than the viscosity $X_{cP}$, the viscosity of the mixture becomes clearly higher than the viscosity $X_{cP}$, this surfactant is said to have a thickening effect.

In a preferred embodiment of the present invention, a water repellent is further applied to the cloth to adjust the water repellency of the cloth within a predetermined range. No particular limitation is imposed on the water repellent useful in the practice of the present invention so far as it has the ability to repel water which is a main component of inks. Examples of the water repellent include paraffins, fluorine-containing compounds, pyridinium salts, N-methylolalkylamides, alkylethyleneureas, oxazoline derivatives, silicone compounds, triazine compounds, zirconium compounds and mixtures thereof. Of these, paraffinic and fluorine-containing type water repellents are particularly preferred from the viewpoints of easy adjustment of water repellency of the cloth, prevention of bleeding and concentration.

In the present invention, the water repellency of the cloth is measured in accordance with the water repellency test (spray method) prescribed in JIS L 1092.

The amount of the water repellent to be applied is preferably within a range of from 0.05 to 40% by weight, more preferably from 0.5 to 10% by weight based on the cloth. The reason is that if the amount is less than 0.05% by weight, the effect of preventing excessive penetration of ink becomes insufficient, and that if the water repellent is contained in an amount exceeding 40% by weight, a great change in performance can no longer be brought about.

Although such a substance as described above is contained in the cloth according to the present invention for the purpose of adjusting the water repellency of the cloth, the cloth may preferably contain compounds other than this. For example, water-soluble salts, urea, catalysts, alkalis, acids, antireductants, antioxidants, level dyeing agents, deep dyeing agents, carriers, reducing agents, oxidizing agents and metal ions may be used.

As compounds particularly effective in prevention of bleeding and improvement of coloring ability, may be mentioned the water-soluble salts. Examples of the water-soluble salts preferably used include alkali metal salts such as NaCl, $Na_2SO_4$, KCl and $CH_3COONa$, alkaline earth metal salts such as $CaCl_2$ and $MgCl_2$, $NH_4Cl$, and $(NH_4)_2SO_4$.

The amount of the water-soluble salt to be applied is preferably within a range of from 0.1 to 30% by weight, more preferably from 1 to 10% by weight based on the cloth.

As the alkalis, those having a weak alkalinity are relatively preferred. As examples thereof, may be mentioned $NaHCO_3$, $Na_2CO_3$, KOH, NaOH, $K_2CO_3$ and $KHCO_3$. The application of the alkali is particularly preferred from the viewpoint of the acceleration of reaction when inks containing a reactive dye are used in textile printing.

The amount of the alkali to be applied is preferably within a range of from 0.1 to 10% by weight, more preferably from 0.5 to 5% by weight based on the cloth.

The cloth according to the present invention preferably contains a water-soluble polymer in addition to the components described above.

Preferable examples of the water-soluble polymer include polyalkylene oxides such as polyethylene oxide and polypropylene oxide, various kinds of starch, cellulosic substances such as carboxymethyl cellulose, methyl cellulose and hydroxyethyl cellulose, sodium alginate, gum arabic, guar gum, gelatin, tannin and derivatives thereof, polyvinyl alcohol and derivatives thereof, water-soluble acrylic polymers, and water-soluble maleic anhydride polymers. These water-soluble polymers preferably have a molecular weight of from 100,000 to 4,000,000, more preferably from 500,000 to 2,500,000.

Of these water-soluble polymers, polyethylene oxide is particularly preferred from the view point that bleed can be effectively prevented.

The amount of the water-soluble polymer to be applied is preferably within a range of from 0.1 to 30% by weight based on the cloth.

In the present invention, besides the above components, a hydrophilic agent and a variety of other additives may be applied to the cloth.

The hydrophilic agent is a substance capable of improving the ink-absorbing ability of a cloth when added in a predetermined amount or more to the cloth as compared with the cloth before its addition. Increase in the absorbing ability can be confirmed by whether the water repellency is reduced, or not, and the degree of the reduction.

As specific examples of a method of applying the hydrophilic agent, there are considered various methods such as a method of containing a surfactant and a method of containing a water-soluble substance having a hydrophilic group. Any of these methods may be used.

As the water-soluble substance having a hydrophilic group used for improving the absorbing ability, those like water-soluble solvents generally incorporated into ink-jet inks are preferred. Examples of usable solvents include lower alkylene glycols such as ethylene glycol, diethylene glycol, triethylene glycol and propylene glycol; lower alkyl ethers of alkylene glycols, such as ethylene glycol methyl (ethyl, propyl or butyl) ether, diethylene glycol methyl (ethyl, propyl or butyl) ether, triethylene glycol methyl (ethyl, propyl or butyl) ether, propylene glycol methyl (ethyl, propyl or butyl) ether, dipropylene glycol methyl (ethyl, propyl or butyl) ether and tripropylene glycol methyl (ethyl, propyl or butyl) ether; glycerol; and thiodiethyleneglycol. Most of them are liquid, but even when those having a high molecular weight may be solid, their effect is not different from that of the liquid.

The water-soluble substance having a hydrophilic group is preferably applied in an amount of 0.1 to 50% by weight, more preferably 1 to 10% by weight based on the cloth. If the amount exceeds 50% by weight, a change in easiness of wetting can no longer be brought about, and such a great amount is hence not preferred from the viewpoint of economy. On the other hand, if the amount is less than 0.1% by weight, the effect of such an agent is not sufficiently exhibited.

The preferable ranges of the water repellent and hydrophilic agent to be added to the cloth are as described above. However, a ratio between the amounts of these agents to be added is important if the hydrophilic agent is applied. With respect to this ratio, the amounts of the water repellent and hydrophilic agent are preferably determined in such a manner that the water repellency of the resulting cloth is less than 50 marks.

Urea is also very effective in prevention of bleed and improvement of a coloring ability. In particular, its combined use with a water-soluble salt has a synergistic effect and is hence preferred. The amount of urea to be applied is preferably within a range of from 0.1 to 30% by weight, more preferably from 1 to 10% by weight based on the cloth.

As a method for incorporating the above-described substances into the cloth, any method such as padding, spraying, dipping, printing or ink-jetting may be used.

After conducting such treatment as described above, the thus-treated cloth is finally dried and optionally cut into sizes feedable in an ink-jet printing apparatus, thereby providing these cut pieces as ink-jet printing cloths.

No particular limitation is imposed on inks used for the ink-jet printing cloths according to the present invention. However, when the cloth is formed of a material such as cotton or silk, inks composed of a reactive dye and an aqueous medium are preferably used. When the cloth is formed of a material such as nylon, wool, silk or rayon, inks composed of an acid or direct dye and an aqueous medium are preferably used. When the cloth is formed of a polyester material, inks composed of a disperse dye and an aqueous medium are preferably used.

As specific preferable examples of these dyes, may be mentioned the following dyes. The reactive dyes include C.I. Reactive Yellow 2, 15, 37, 42, 76, 95, 168 and 175; C.I. Reactive Red 21, 22, 24, 33, 45, 111, 112, 114, 180, 218, 226, 228 and 235; C.I. Reactive Blue 15, 19, 21, 38, 49, 72, 77, 176, 203, 220, 230 and 235; C.I. Reactive Orange 5, 12, 13, 35 and 95; C.I. Reactive Brown 7, 11, 33, 37 and 46; C.I. Reactive Green 8 and 19; C.I. Reactive Violet 2, 6 and 22; C.I. Reactive Black 5, 8, 31 and 39; and the like.

The acid and direct dyes include C.I. Acid Yellow 1, 7, 11, 17, 23, 25, 36, 38, 49, 72, 110 and 127; C.I. Acid Red 1, 27, 35, 37, 57, 114, 138, 254, 257 and 274; C.I. Acid Blue 7, 9, 62, 83, 90, 112 and 185; C.I. Acid Black 26, 107, 109 and 155; C.I. Acid Orange 56, 67 and 149; C.I. Direct Yellow 12, 44, 50, 86, 106 and 142; C.I. Direct Red 79 and 80; C.I. Direct Blue 86, 106, 189 and 199; C.I. Direct Black 17, 19, 22, 51, 154, 168 and 173; C.I. Direct Orange 26 and 39; and the like.

The disperse dyes include C.I. Disperse Yellow 3, 5, 7, 33, 42, 60, 64, 79, 104, 160, 163 and 237; C.I. Disperse Red 1, 60, 135, 145, 146 and 191; C.I. Disperse Blue 56, 60, 73, 143, 158, 198, 354, 365 and 366; C.I. Disperse Black 1 and 10; C.I. Disperse Orange 30 and 73; Teraprint Red 3GN Liquid and Teraprint Black 2R; and the like.

The amount (in terms of solids) of these dyes to be used is preferably within a range of from 1 to 30% by weight, more preferably from 1 to 20% by weight based on the total weight of the ink.

As the aqueous medium used together with the dyes, there may be used any aqueous medium generally used in inks. Preferable examples thereof include lower alkylene glycols such as ethylene glycol, diethylene glycol, triethylene glycol and propylene glycol; lower alkyl ethers of alkylene glycols, such as ethylene glycol methyl (ethyl, propyl or butyl) ether, diethylene glycol methyl (ethyl, propyl or butyl) ether, triethylene glycol methyl (ethyl, propyl or butyl) ether, propylene glycol methyl (ethyl, propyl or butyl) ether, dipropylene glycol methyl (ethyl, propyl or butyl) ether and tripropylene glycol methyl (ethyl, propyl or butyl) ether; polyalkylene glycols such as polyethylene glycol and polypropylene glycol and products obtained by modifying one or two hydroxyl groups thereof, typified by mono- or dialkyl ethers thereof; glycerol; thiodiethylene glycol; sulfolane; N-methyl-2-pyrrolidone; 2-pyrrolidone; and 1,3-dimethyl-2-imidazolidinone. The preferable content of these aqueous media is preferably within a range of generally from 0 to 50% by weight, more preferably from 0 to 30% by weight based on the total weight of the ink.

In the case of a water-based ink, the content of water as a principal component is preferably within a range of from 30 to 95% by weight, more preferably from 50 to 95% by weight based on the total weight of the ink.

Besides the above components, anti-clogging agents such as urea and derivatives thereof, dispersants, surfactants, viscosity modifiers such as polyvinyl alcohol, cellulosic compounds and sodium alginate, pH adjustors, optical whitening agents, mildew proofing agents, and the like may be added as other ingredients for inks as needed.

As an ink-jet recording method and apparatus used, there may be used any method and apparatus conventionally known. Examples thereof include a method and an apparatus in which thermal energy corresponding to recording signals is applied to an ink within a recording head, and ink droplets are generated by this thermal energy.

The inks applied onto the ink-jet printing cloth of the present invention in accordance with the process of the present invention in the above-described manner is only attached to the cloth in this state. Accordingly, it is preferable to subsequently subject the cloth to a process for fixing the dyes in the inks to fiber and a process for removing unfixed dyes. Such a fixing process may be conducted in accordance with any conventionally-known method. Examples thereof include a steaming process, an HT steaming process and a thermofix process. The removal of the unreacted dyes may be performed by any washing process conventionally known.

After conducting the ink-jet printing and the post-treatment of the cloth in the above-described manner, the cloth is dried to provide a print according to the present invention.

An exemplary construction of an ink-jet printing apparatus used in the present invention will hereinafter be roughly described. It goes without saying that the apparatus to which the present invention can be applied is not limited to the construction as described below. It is therefore possible to make any change in construction and add any structural element, which are easily conceived by those skilled in the art.

FIG. 1A is a typical sectional side elevation schematically illustrating the construction of a printing apparatus. Reference numeral 1 designates a cloth as a printing medium. The cloth 1 is unwound according to the rotation of a rewind roller 11, fed in a substantially horizontal direction by a conveyance section 100, which is provided at a position opposite to a printer section 1000, through intermediate rollers 13 and 15, and then wound up on a take-up roller 21 through a feed roller 17 and an intermediate roller 19.

The conveyance section 100 roughly includes conveyance rollers 110 and 120 respectively provided on the upstream and downstream sides of the printer section 1000 viewing from the feeding direction of the cloth 1, a conveyor belt 130 in the form of an endless belt, which is extended between and around these rollers, and a pair of platen rollers 140 provided so as to extend the conveyor belt 130 under an appropriate tension in a predetermined range to enhance its evenness, thereby evenly regulating the surface of the cloth 1 to be printed upon printing by the printer section 1000. In the illustrated apparatus, the conveyor belt 130 is made of a metal as disclosed in Japanese Patent Application Laid-Open No. 5-212851. As illustrated in FIG. 1B with partial enlargement, an adhesive layer (sheet) 133 is provided on its surface. The cloth 1 is adhered to the conveyor belt 130 through the adhesive layer 133 by an attaching roller 150, thereby ensuring the evenness of the cloth 1 upon printing.

To the cloth 1, fed in a state such that the evenness has been ensured as described above, is applied a printing agent in the region between the platen rollers 140 by the printer section 1000. The thus-printed cloth 1 is separated from the conveyor belt 130, or the adhesive layer 133 at the position of the conveyance roller 120 and wound up on the take-up roller 21. In the course of the winding, the cloth 1 is subjected to a drying treatment by a drying heater 600. In particular, this drying heater 600 is effective when a liquid agent is used as the printing agent. The form of the drying heater 600 may be suitably selected from a heater by which hot air is blown on the cloth 1, a heater by which infrared rays are applied to the cloth 1, and the like.

Figure 2:
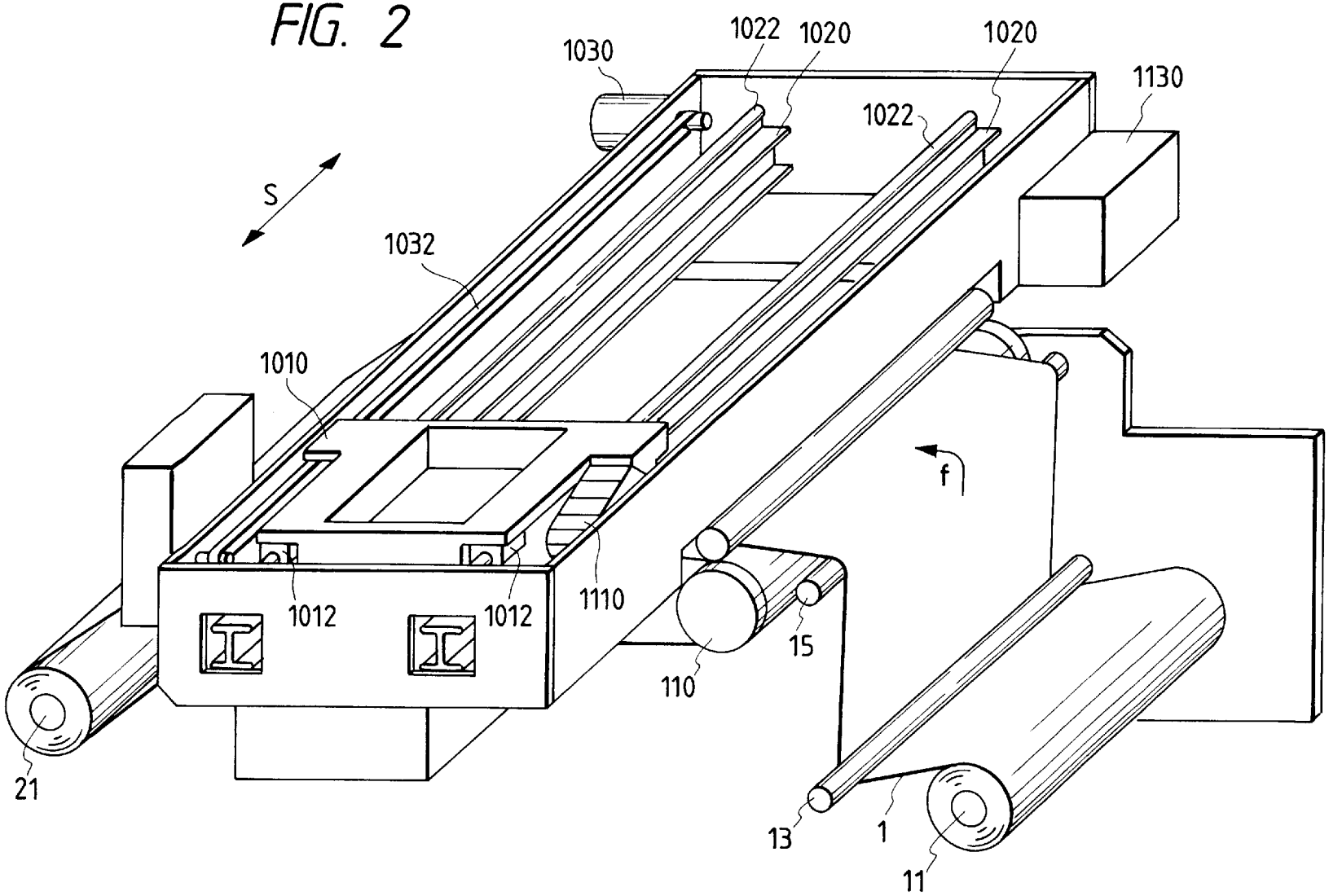
FIG. 2 is a perspective view typically illustrating a printer section and a conveyance section in the apparatus shown in FIG. 1A.

FIG. 2 is a perspective view typically illustrating the printer section 1000 and the feed system of the cloth 1. The construction of the printer section 1000 will be described with reference to this drawing (FIG. 2) and FIG. 1A.

In FIGS. 1A and 2, the printer section 1000 includes a carriage 1010 which scans in a direction different from the conveying direction (a secondary scanning direction) f of the cloth 1, for example, the width direction S of the cloth 1 perpendicular to the conveying direction f. Reference numeral 1020 designates a support rail extending in the S direction (a main scanning direction) and supporting a slide rail 1022 which supports and guides a slider 1012 fixed to the carriage 1010. Reference numeral 1030 indicates a motor as a drive source for conducting the main scanning of the carriage 1010. The driving power thereof is transmitted to the carriage 1010 through a belt 1032 to which the carriage 1010 has been fixed, or another suitable drive mechanism.

On the carriage 1010, are mounted sets of printing heads 1100 each having many printing agent-applying elements arranged in a predetermined direction (in this case, the conveying direction f), said sets each being composed of a plurality of the printing heads 1100 arranged in a direction (in this case, the main scanning direction S) different from said predetermined direction. In this embodiment, two sets of the printing heads 1100 are held in the conveying direction. In each set, the printing heads 1100 are provided in a number corresponding to the number of printing agents of different colors, thereby permitting color printing. Colors of the printing agents and the number of the printing heads in each set may be suitably selected according to an image intended to be formed on the cloth 1, and the like. For example, yellow (Y), magenta (M) and cyan (C), or the three primary colors for printing, or black (Bk) in addition to these colors may make one set. Alternatively, special colors (metallic colors such as gold and silver, and bright red, blue, etc. ), which are impossible or difficult to be expressed by the three primary colors, may be used in place of or in addition to the above color set. Further, a plurality of printing agents may be used according to their color depth even if they have the same colors as each other.

In this embodiment, as illustrated in FIG. 1A, two sets of the printing heads 1100, which each are composed of plural printing heads arranged in the main scanning direction S, are provided one by one in the conveying direction f. The colors, arranging number, arranging order and the like of the printing agents used in the printing heads in the respective sets may be the same or different from each other according to the image intended to be printed, and the like. Further, printing may be made again by the printing heads of the second set on a region printed by main scanning of the printing heads of the first set (either complementary thinning-out printing or overlap printing may be conducted by the respective sets of the printing heads). Furthermore, a printing region may be allotted to each set to perform high-speed printing. Besides, the number of sets of the printing heads is not limited to two and may also be defined as one or more than two.

In these drawings, ink-jet heads, for example, bubble jet heads proposed by Canon Inc., each having a heating element which generates thermal energy causing film boiling of ink as energy used for ejecting the ink, are used as the printing heads 1100. Each of the printing heads is used in a state that ink ejection orifices as the printing agent-applying elements have been disposed downward toward the cloth 1 substantially horizontally conveyed by the conveyance section 100, thereby ironing out the difference in water head between the individual ejection orifices and hence making ejection conditions uniform to permit both formation of good images and even purging operation for all the ejection orifices.

A flexible cable 1110 is connected to each of the printing heads 1100 in such a manner that it follows the movement of the carriage 1010, so that various signals such as drive signals and state signals for the head are transferred between the head and control means not illustrated. Inks are fed from an ink-feeding system 1130, in which respective inks of different colors are contained, to the printing heads 1100 through flexible tubes 1120.

Figure 3:
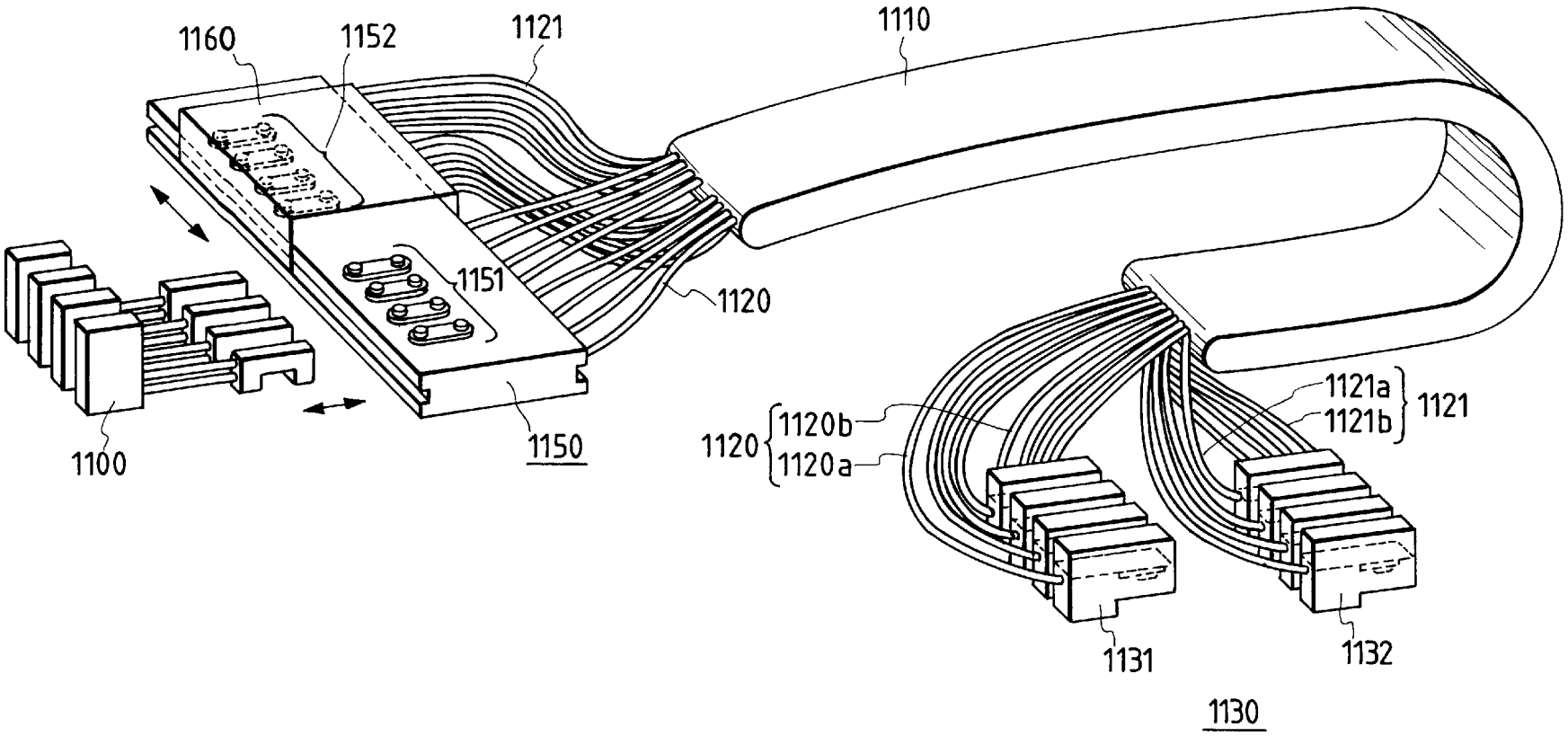
FIG. 3 is a typical perspective view of an ink-feeding system in the apparatus shown in FIG. 1A.

FIG. 3 is a perspective view typically illustrating the ink-feeding system in this embodiment. The ink-feeding system 1130 is composed of two lines. More specifically, in the first line, first ink-feeding tubes 1120 respectively connected to the first set of ink-storage tanks 1131 are connected to a head joint 1150 through the flexible tube 1110. In the second line, similarly, second ink-feeding tubes 1121 respectively connected to the second set of ink-storage tanks 1132 are connected to the head joint 1150 through the flexible tube 1110.

Each ink-feeding tube 1120 or 1121 forms a circulation path composed of an outward ink-feeding tube 1120*a* or 1121*a* and an inward ink-feeding tube 1120*b* or 1121*b*.

The ink-storage tanks 1131 and 1132 each have a pressure pump (not illustrated). The ink in the tank 1131 or 1132 is pressurized by this pressure pump so as to pass through the outward ink-feeding tube 1120*a* or 1121*a* as illustrated in FIG. 3, circulate through the printing head 1100 and then pass through the inward ink-feeding tube 1120*b* or 1121*b*, thereby returning to the ink-storage tank 1131 or 1132.

By this pressure pump, it is possible to recharge the inks into the ink-feeding tubes 1120 and 1121 and also to conduct a purging operation of the head by circulating the ink through the head and discharging a fraction of this ink out of nozzles in the head. The ink-storage tanks 1131 and 1132 may be provided respectively by a number corresponding to the number of the printing agents of different colors, thereby permitting color printing.

The number of the ink-storage tanks in each set may be suitably selected according to an image intended to be formed on the cloth 1, and the like. For example, three tanks for yellow (Y), magenta (M) and cyan (C) colors, or the three primary colors for printing, or four tanks with a tank for a black (Bk) color added to these tanks may be provided. Alternatively, tanks for special colors (metallic colors such as gold and silver, and bright red, blue, etc.), which are impossible or difficult to be expressed by the three primary colors, may be used in place of or in addition to the above tanks. Further, a plurality of tanks may be used according to the color depth even if printing agents used have the same colors as each other.

The head joint 1150 is composed of a head joint 1151 for the first set indicated by a full line, a head joint 1152 for the second set indicated by a broken line and a joint cover 1160 as illustrated in FIG. 3.

The construction of the head used in the above-described apparatus will hereinafter be described schematically with reference to FIG. 4.

Figure 4:
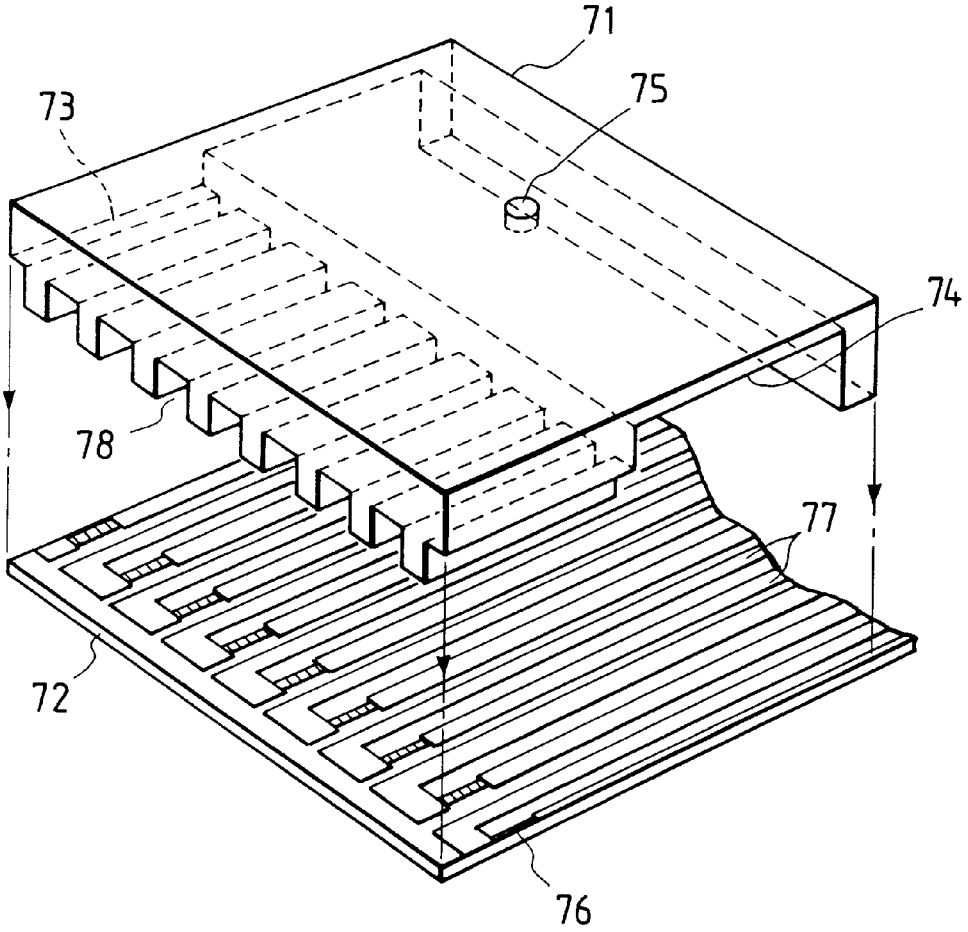
FIG. 4 is a perspective view schematically illustrating the construction of a printing head to be mounted on the apparatus shown in FIG. 1A.

FIG. 4 is a sectional perspective view schematically illustrating the construction of an ink-jet head to be mounted on the ink-jet printing apparatus used in the present invention.

In this drawing, the printing head is constructed by overlapping a top plate 71 and a base plate 72. The top plate 71 has a plurality of grooves 73, which are to define nozzles passing an ink therethrough, a groove 74, which is to define a common liquid chamber communicating with these grooves, and a feed opening 75 for feeding the ink to the common liquid chamber. On the other hand, the base plate 72 includes electrothermal converters 76 corresponding to the individual nozzles and electrodes 77 for supplying electric power to the electrothermal converters 76, respectively, said electrothermal converters 76 and electrodes 77 being formed integrally by a film-forming technique. Plural ejection openings (orifices) 78 through which the ink is ejected are defined by overlapping the top plate 71 and the base plate 72 as described above.

Here, the process of forming ink droplets by the bubble jet system, which is carried out by the above-described printing head, will be described simply.

When a heating resistor (heater) reaches a predetermined temperature, such a filmy bubble as covers a heater surface is first formed. The internal pressure of this bubble is very high, and so an ink within a nozzle is forced out. The ink is moved toward the outside of the nozzle and the interior of the common liquid chamber, which is situated in an opposite direction to the nozzle, by inertia by this forcing out. When the movement of the ink is facilitated, the moving speed of the ink within the nozzle becomes slow because the internal of the bubble turns negative pressure, and flow path resistance also arises in addition. Since the ink portion ejected out of the ejection opening (orifice) is faster in moving speed than the ink within the nozzle, it is constricted by the balance among inertia, flow path resistance, shrinkage of the bubble and surface tension of the ink, whereby the ink portion is separated into a droplet. At the same time as the shrinkage of the bubble, the ink is fed to the nozzle from the common liquid chamber by capillary force to wait for the next pulse.

As described above, the printing head (which hereinafter may be referred to as an ink-jet head), in which the electrothermal converter is used as an energy-generating means (which hereinafter may be referred to as an energy-generating element), can generate a bubble in the ink within the flow path in one-to-one correspondence in accordance with a driving electrical pulse signal and also immediately and appropriately cause the growth/shrinkage of the bubble, and so the ejection of ink droplets can be achieved with excellent responsiveness in particular. The printing head is advantageous in that it can also be made compact with ease, merits of IC techniques and macro processing techniques in the recent semiconductor field, which are remarkable for advances in technique and enhancement in reliability, can be fully applied thereto, high-density mounting can be achieved with ease, and production costs are also low.

The present invention will hereinafter be described more specifically by the following examples and comparative examples. Incidentally, all designations of "part" or "parts" and "%" as will be used in the following examples mean part or parts by weight and% by weight unless expressly noted.

EXAMPLES 1 to 10

(A) Production of Ink-Jet Printing Cloth:

Using 100% cotton satin (mercerized product), 100% silk crepe de Chine and 100% polyester tropical fabric, pretreatments using their corresponding pretreatment agents shown in Table 1 were conducted by the padding process. The thus-pretreated fabrics were then squeezed to a pickup of 90% by a mangle and dried at a drying temperature of 120° C. for 2 minutes.

(B) Preparation of Ink-Jet Printing Inks:

Reactive dye inks and disperse dye inks were prepared in the following manner. The total amounts of the inks are all 100 parts.

| (1) Reactive dye inks | |
|---|---|
| Reactive dye | 10 parts |
| Thiodiglycol | 40 parts |
| Water | 50 parts. |

Dyes used were C.I. Reactive Yellow 95, C.I. Reactive Red 226, C.I. Reactive Blue 15 and C.I. Reactive Black 39.

(2) Disperse dye inks:

| | |
|---|---|
| Disperse dye | 10 parts |
| Thiodiglycol | 40 parts |
| Water | 50 parts. |

Dyes used were C.I. Disperse Yellow 42, Teraprint Red 3GN Liquid (trade name, disperse dye produced by Ciba-Geigy AG) and Teraprint Black 2R (trade name, disperse dye produced by Ciba-Geigy AG), which contain each a dispersing agent for dispersing the dyes.

(C) Ink-Jet Printing:

Using a Bubble Jet Printer BJC-820J (trade name, manufactured by Canon Inc.) as an ink-jet printing apparatus, the above-prepared printing inks were separately charged in this printer. The fabrics were separately mounted on base paper webs to permit the conveying of the fabrics, thereby printing the fabrics. Any printing apparatus may be used without being limited to the above printer.

(D) Post-Treatment:

The printed fabrics were subjected to a steaming treatment at 100° C. for 8 minutes for the reactive dye inks, and at 180° C. for 10 minutes for the disperse dye inks. The thus-treated cloths were washed and then dried.

(E) Evaluation of Prints:

The thus-obtained print samples and the fabrics used were evaluated in the following manner. The results thereof are shown collectively in Table 1.

(1) Bleeding:

The linearity of fine-line portions in each print sample was visually observed to rank resistance to bleeding in accordance with the following standard:

A: Good;

B: Somewhat poor;

C: Poor.

(2) Color Depth (K/S) of Print:

A minimum spectral reflectance of a 20×20 mm square printed portion in each print sample was measured by a Minolta Spectrocolorimeter CM-2022 (trade name). A K/S value was found from this reflectance. The color depth of each print sample was ranked in terms of this K/S value in accordance with the following standard:

A: Greater than 13;

B: 10 to 13;

C: Smaller than 10.

(3) Drying Property:

Printing was conducted by the BJC-820J printer, and the printed area was rubbed with a cloth upon elapsed time of 30 seconds after the printing. The drying property was evaluated by whether ink smearing occurred or not and ranked in accordance with the following standard:

A: No ink smearing occurred;

C: Ink smearing occurred.

(4) Water Repellency:

Each fabric sample was sprayed with 250 ml of water by a Spray Tester (trade name, manufactured by Daiei Kagaku Seiki Seisakusho) in accordance with the water repellency test (spray method) prescribed in JIS L 1092. The water repellency was ranked in terms of 0 to 100 marks according to the wet state of the sample after the test.

Comparative Examples 1 and 2

Ink-jet printing and evaluation were conducted in the same manner as in Example 1 except that their corresponding pretreatment agents shown in Table 1 were used. The results thereof are shown collectively in Table 1.

TABLE 1

| | Cloth | Pretreatment agent<br>Treatment agent/Concentration of aqueous solution (%) | water repellency | Bleeding | Color depth | Drying property |
|---|---|---|---|---|---|---|
| Ex. 1 | Cotton | Aqueous auxiliary 1/2, Thickening surfactant 1/0.6, NaCl/5, $NaHCO_3$/3, Water repellent/3 | 0 | A | A | A |
| Ex. 2 | Cotton | Aqueous auxiliary 1/2, Thickening surfactant 1/0.6, $NH_4Cl$/4, $Na_2CO_3$/5, Water repellent/3 | 0 | A | A | A |
| Ex. 3 | Cotton | Aqueous auxiliary 2/1, Thickening surfactant 1/0.5, $Na_2SO_4$/3, $NaHCO_3$/3, Water repellent/3 | 0 | A | A | A |
| Ex. 4 | Polyester | Aqueous auxiliary 1/2, Thickening surfactant 1/0.6, Water repellent/3 | 0 | A | A | A |
| Ex. 5 | Polyester | Aqueous auxiliary 2/0.3, Thickening surfactant 1/0.4, Water repellent/3, Water-soluble polymer/1 | 0 | A | A | A |
| Ex. 6 | Silk | Aqueous auxiliary 2/0.2, Thickening surfactant 1/0.3, NaCl/3, $NaHCO_3$/3 | 0 | A | A | A |
| Ex. 7 | Cotton | Thickening surfactant 2/2, Aqueous auxiliary 3/1, $NaHCO_3$/2; Water repellent/3 | 0 | A | A | A |
| Ex. 8 | Cotton | Thickening surfactant 2/2, Aqueous auxiliary 1/1, Thickening surfactant 1/0.6, $NaHCO_3$/2, Water repellent/3 | 0 | A | A | A |
| Ex. 9 | Polyester | Aqueous auxiliary 1/4, Thickening surfactant 2/3 | 0 | A | A | A |
| Ex. 10 | Polyester | Aqueous auxiliary 3/2, Thickening surfactant 3/1, Water repellent/3, Water-soluble polymer/1 | 0 | A | A | A |
| Comp. Ex. 1 | Cotton | Aqueous auxiliary 1/2, NaCl/5, $NaHCO_3$/3, Water repellent/3 | 0 | C | B | A |
| Comp. Ex. 2 | Cotton | Thickening surfactant 1/0.6, NaCl/5, $NaHCO_3$/3, Water repellent/3 | 0 | C | B | A |

Notes for Table 1:

Water-soluble polymer:

Alkox E60 (trade name, polyethylene oxide produced by Meisei Chemical Works, Ltd.; molecular weight: 1,100,000).

Aqueous auxiliary 1:

Lutensol AT25 (trade name, polyoxyethylene alkyl ether produced by BASF AG; HLB: 16).

Thickening surfactant 1:

BL 4.2 (trade name, polyoxyethylene lauryl ether produced by Nikko Chemicals Co., Ltd.).

Aqueous auxiliary 2:

Acetylenol EH (trade name, polyoxyethylene acetylene glycol produced by Kawaken Fine Chemicals Co., Ltd.; HLB: 16).

Thickening surfactant 2:

AM-3130N (trade name, coconut oil fatty acid type acetic acid betaine produced by-Nikko Chemicals Co., Ltd.).

Aqueous auxiliary 3:

Migregirl NC-2 (trade name, anionic surfactant produced by Senka K. K.).

Thickening surfactant 3:

AM-301 (trade name, lauryldimethylaminoacetic acid betaine produced by Nikko Chemicals Co., Ltd.).

Water repellent:

Paragium SS (trade name, paraffinic softening water repellent produced by Ohara Paragium Chemical Co., Ltd.).

As apparent from Table 1, all the prints according to Examples 1 to 10 were free of bleeding, high in color depth and also excellent in drying property, whereas the cloths according to Comparative Examples 1 and 2 gave unfavorable results such as low color depth and occurrence of bleeding.

As has been described above, the ink-jet printing cloths and printing process according to the present invention permit the provision of bright prints excellent in drying property, free of bleeding and high in color depth and image quality.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet printing cloth having a hydrophilic auxiliary in an amount of from 0.1 to 30% by weight and a lipophilic surfactant which thickens in viscosity in combination with the hydrophilic auxiliary in an amount of from 0.1 to 30% by weight, based on the weight of the cloth, respectively, incorporated thereinto, wherein the hydrophilic auxiliary is an anionic surfactant, a nonionic surfactant, an amphoteric surfactant, or a hydrophilic high-boiling organic solvent and the lipophilic surfactant has an HLB of 12 or lower.

2. The ink-jet printing cloth according to claim 1, wherein the weight ratio of the hydrophilic auxiliary to the lipophilic surfactant falls within a range of from 1:3 to 3:1.

3. The ink-jet printing cloth according to claim 1, wherein the content of the hydrophilic auxiliary falls within a range of from 0.1 to 10% by weight based on the cloth.

4. The ink-jet printing cloth according to claim 1, wherein the content of the lipophilic surfactant falls within a range of from 0.1 to 10% by weight based on the cloth.

5. The ink-jet printing cloth according to claim 1, wherein the lipophilic surfactant is a nonionic surfactant.

6. The ink-jet printing cloth according to claim 5, wherein the lipophilic surfactant is a polyoxyethylene alkyl ether surfactant.

7. The ink-jet printing cloth according to claim 1, wherein the hydrophilic auxiliary is an anionic surfactant having an HLB of 12.5 or higher.

8. The ink-jet printing cloth according to claim 1, wherein the hydrophilic high-boiling organic solvent is glycerol or polyethylene glycol.

9. The ink-jet printing cloth according to claim 1, which further comprises a water repellent in a proportion of from 0.05 to 40% by weight based on the cloth.

10. The ink-jet printing cloth according to claim 9, wherein the water repellent is contained in a proportion of from 0.5 to 10% by weight based on the cloth.

11. The ink-jet printing cloth according to claim 9, wherein the water repellent is a paraffinic or fluorine-containing water repellent.

12. The ink-jet printing cloth according to claim 9, which has a water repellency less than 50 marks as measured in accordance with the water repellency test prescribed in JIS L 1092.

13. The ink-jet printing cloth according to claim 1, which further comprises a water-soluble salt in a proportion of from 0.1 to 30% by weight based on the cloth.

14. The ink-jet printing cloth according to claim 13, wherein the water-soluble salt is contained in a proportion of from 1 to 10% by weight based on the cloth.

15. The ink-jet printing cloth according to claim 1, which further comprises an alkali in a proportion of from 0.1 to 10% by weight based on the cloth.

16. The ink-jet printing cloth according to claim 15, wherein the alkali is contained in a proportion of from 0.5 to 5% by weight based on the cloth.

17. The ink-jet printing cloth according to claim 1, which further comprises a water-soluble polymer in a proportion of from 0.1 to 30% by weight based on the cloth.

18. The ink-jet printing cloth according to claim 17, wherein the water-soluble polymer is polyethylene oxide.

19. An ink-jet printing process comprising ejecting inks from an ink-jet printing apparatus to print a cloth, wherein the cloth according to any one of claims 1, 2 to 6 or 7 to 18 is used as said cloth.

20. The ink-jet printing process according to claim 19, wherein thermal energy is applied to the inks to eject the inks.

21. A print produced in accordance with the ink-jet printing process according to claim 19.

* * * * *

UNITED STATES PATENT AND TRADEMARK OFFICE

CERTIFICATE OF CORRECTION

PATENT NO. : 5,976,673

DATED : November 2, 1999

INVENTOR(S) : MAKOTO AOKI

It is certified that error appears in the above-identified patent and that said Letters Patent is hereby corrected as shown below:

COLUMN 12:

TABLE 1, Line 59, In Ex. 9 and Col. "Bleeding", "A" should read --B--.

COLUMN 14:

Line 53, "claims 1, 2 to 6 or 7 to 18" should read --claims 1 to 18--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*